United States Patent [19]

Lee

[11] 4,178,056

[45] Dec. 11, 1979

[54] ELECTRIC PLUG WITH NOVEL CABLE SECURING MEANS

[76] Inventor: Hop Lee, 2455-24th Ave., San Francisco, Calif. 94116

[21] Appl. No.: 915,927

[22] Filed: Jun. 15, 1978

[51] Int. Cl.[2] ..... H01R 13/58

[52] U.S. Cl. ..... 339/103 R; 339/14 RP

[58] Field of Search ..... 339/103, 14 RP, 14 R, 339/143 R; 285/192

[56] References Cited

U.S. PATENT DOCUMENTS

| | | | |
|---|---|---|---|
| 2,577,748 | 12/1951 | Gillespie | 285/192 X |
| 2,911,616 | 11/1959 | Townsend | 339/103 R X |
| 3,189,865 | 6/1965 | Hawkes, Jr. | 339/103 C X |

FOREIGN PATENT DOCUMENTS

| | | | |
|---|---|---|---|
| 2023168 | 12/1970 | Fed. Rep. of Germany | 339/103 R |

*Primary Examiner*—Neil Abrams
*Assistant Examiner*—DeWalden W. Jones
*Attorney, Agent, or Firm*—William R. Piper

[57] ABSTRACT

An electric plug in which novel cable securing means is used for anchoring the cable to the plug so that any pull on the cable will prevent the cable from being pulled free from the plug and will also prevent the three wires in the cable from being accidentally disconnected from their associate electrodes. The electric plug has three electrodes with portions projecting beyond the plug, these portions being hook-shaped and designed to enter three openings in an electric outlet box, the plug being rotatable through an angle for securing the plug to the box.

1 Claim, 7 Drawing Figures

FIG-1-
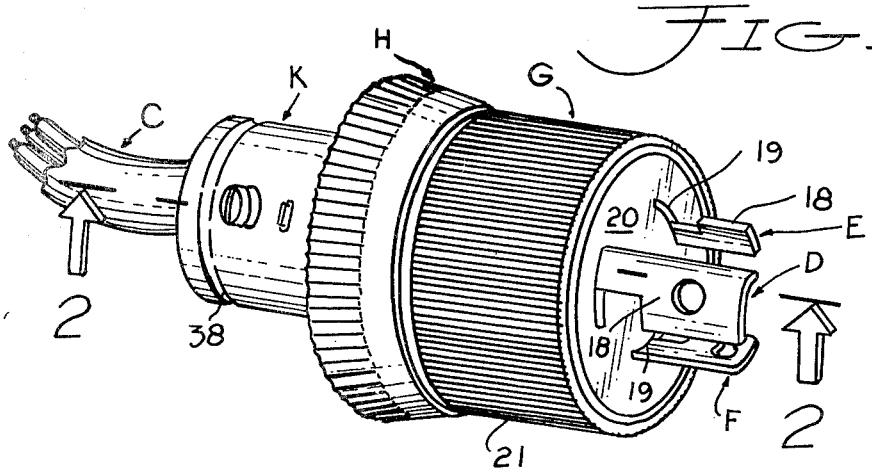
FIG-2-
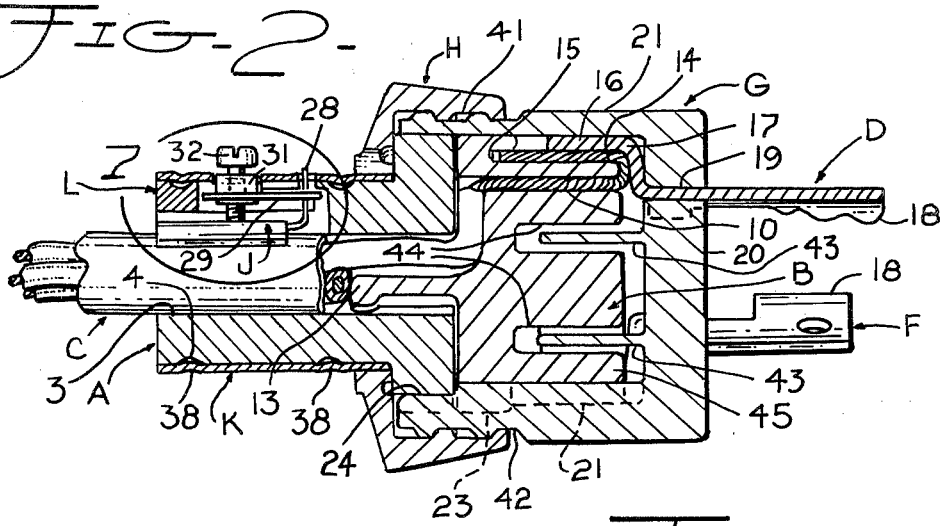
FIG-5-
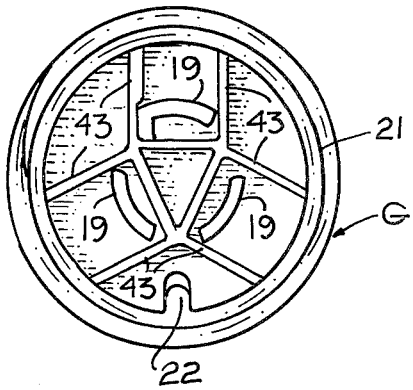
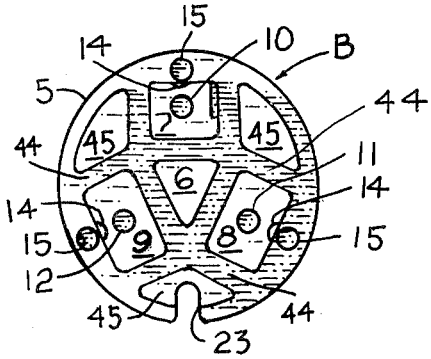
FIG-4-

ELECTRIC PLUG WITH NOVEL CABLE SECURING MEANS

SUMMARY OF THE INVENTION

An object of my invention is to provide an electric plug having novel cable securing means for anchoring the cable to the plug and preventing the accidental freeing of the cable from the plug should the cable be manually pulled. The electrical contact between the three wires in the cable and their associate electrodes is effected without the need of using fastening screws and in this respect the structure for making this electrical connection is similar to that shown in my co-pending patent application on an electric plug, Ser. No. 886,669, filed Mar. 15, 1978.

BRIEF DESCRIPTION OF THE DRAWINGS

FIG. 1 is an isometric view of the electric plug.

FIG. 2 is a longitudinal section through the plug and is taken along the line 2—2 of FIG. 1.

FIG. 4 is an end view of the carrier for the three electrodes when looking in the direction of the arrows 4—4 in FIG. 3. The electrodes are not illustrated in FIG. 4.

FIG. 5 is an inner end view of the end cap when looking in the direction of the arrows 5—5 of FIG. 3. The three electrodes are not shown in FIG. 5.

DESCRIPTION OF THE PREFERRED EMBODIMENT

Figures 3, 6, 7:
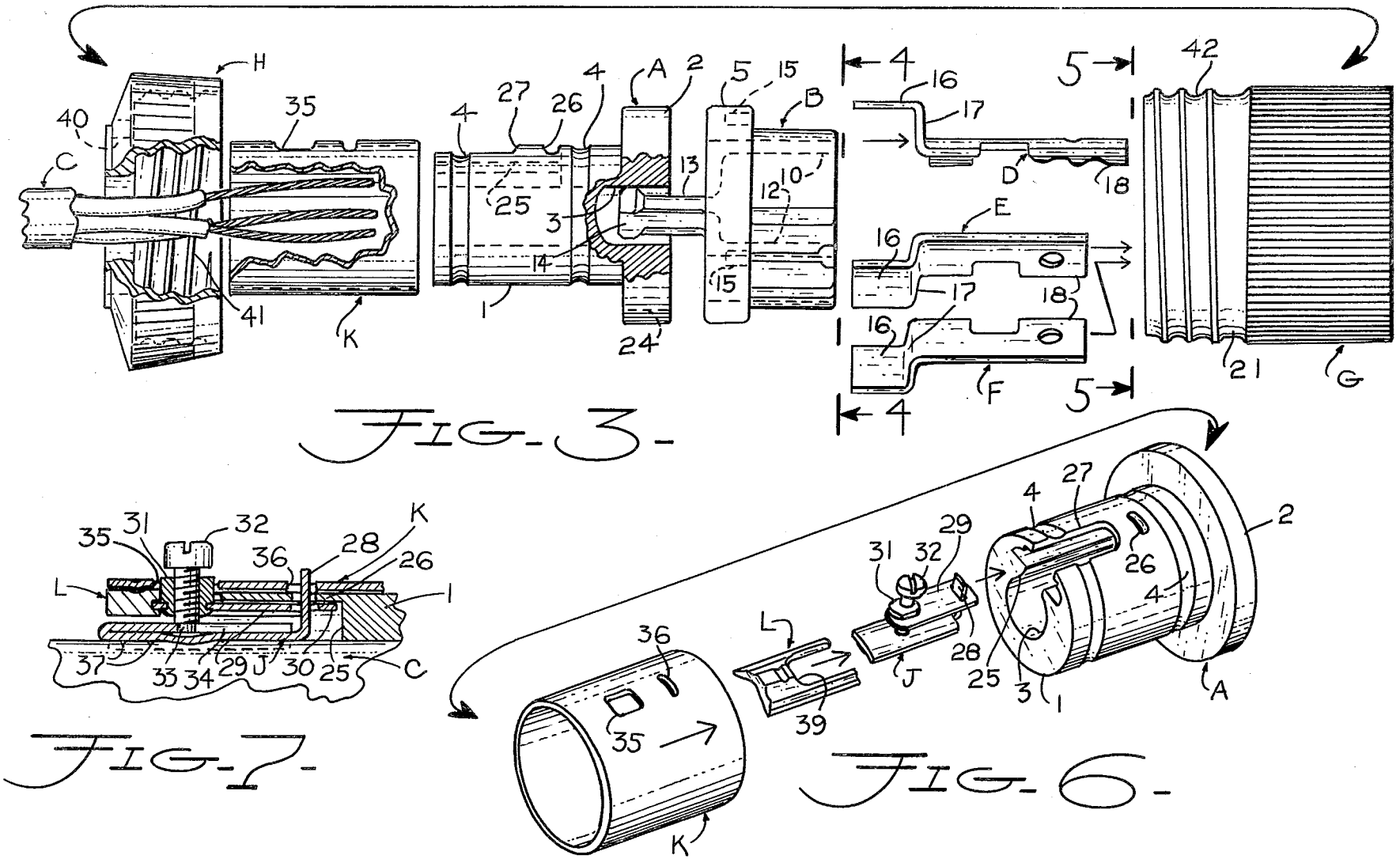
FIG. 3 is an exploded view of the various parts of the electric plug and some of the parts are partially shown in section or with portions removed for the purpose of clarity.
FIG. 6 is an exploded isometric view of the parts that cooperate to provide the novel cable securing means for anchoring the cable to the electric plug and for preventing the accidental removal of the cable from the plug when the cable is manually pulled.
FIG. 7 is an enlarged section of the circled portion 7 shown in FIG. 2.

In carrying out my invention I will first refer to FIG. 3 where the various parts of the electric plug are illustrated. The inner member A, has a cylindrical body 1 with an annular flange 2 at one end, see also the isometric showing of the member A in FIG. 6. An axial bore 3 extends throughout the length of the member A and the cylindrical body 1 has two spaced apart annular grooves 4 for a purpose later to be described.

An electrode carrier B, is shown in FIGS. 2, 3 and 4, and it has a base 5 with a central axially extending projection 6, integral with the base. An end view of the projection 6 is shown in FIG. 4. Disposed around the central projection 6 and spaced a slight distance from the three sides of the projection are wire strand receiving projections 7, 8 and 9, and these parallel the central projection 6 and are equal in length. Each of these three projections has a center, longitudinally extending bore therein for receiving the metal strands of the three wires carried by the cable C, see also FIG. 2. The three bores are indicated at 10, 11 and 12 in FIG. 4.

The electrode carrier B, has another axial extending projection 13 integral with the base 5 and being receivable in the bore 3 of the inner member A, see FIG. 3. The projection 13 has three longitudinally extending grooves in its outer surface for receiving the three wires in the cable C. One of these grooves is shown at 14 in FIG. 3. The three wires extend along the grooves and into associate radially extending grooves in the base 5. At this point the coverings for the three wires are removed and the bore metal strands of these wires are passed through the bores 10, 11 and 12 in the three projections 7, 8 and 9, respectively, and are then folded over the outer ends of these projections and then back along their outer surfaces and received in longitudinal grooves 14 in these projections, see FIG. 4, where the grooves 14 are shown and FIG. 5 where the bore wire strands of one of the wires is illustrated. The ends of the strands are received in recesses 15 in the base 5, see FIG. 2.

The electric plug has three electrodes D, E and F, as shown in FIGS. 1, 2 and 3. These electrodes are substantially identical to each other and therefore a description of one will suffice for all. The electrode D, in FIG. 3 has an offset portion 16 and a shoulder 17 with a hook-shaped outer end 18. In the sectional view of FIG. 2, and the isometric view of FIG. 1, the shanks of the three electrodes extend through openings 19 in the closed end 20 of an end cap G. This end cap has an integral cylindrical portion 21 which receives the electrode carrier B. In order to make certain that the end cap G, is properly aligned with the electrode carrier B, and that the two are in proper registration, the end cap has a longitudinally extending key 22, on the inner cylindrical surface of the portion 21 that registers with and is received in the key way 23 in the electrode carrier B. The key 22 also extends into a longitudinal groove 24 in the rim of the annular flange 2 of the inner member A, see FIG. 3. In this manner the three parts, A, B and G are properly and angularly aligned with each other when they are in assembled position as indicated in FIG. 2.

When the electrode carrier B, is received in the end cap G, the closed end 20 thereof will have its inner surface press down upon the shoulders 17 of the three electrodes D, E and F, and bring them into electrical contact with the bare wire strands of the three wires. A top cap H, will interconnect the inner body A, and the electrode carrier B to the end cap G, in the manner shown in FIG. 2, but before describing this in further detail it is best to set forth the structure of the novel cable securing means.

In FIGS. 2, 3, 6, and 7, I show the cylindrical portion 1 of the inner member A provided with a recess 25 on its inner surface and with an opening 26 leading from the recess to the exterior surface of the portion 1. The cylindrical body 1 also has a slot 27, see FIG. 6 in alignment with the opening 26 and communicating with the recess 25. The cable gripping apparatus includes a cable gripping member J that has a tongue 28, bent at right angles to the main portion of the member and extending through the opening 26, see FIG. 7.

A nut-carrying member 29 has an opening 30 for receiving the tongue 28 of the cable gripping member J, and it has a nut 31 secured thereto, see FIG. 7. A bolt 32 is received in the nut and the opposite end of the bolt has a groove 33 received in a slot 34 in the member J. The member J and the bolt 32 with its associate parts are placed as a unit in the recess 25 of the body 1 of the inner member A, so that the tongue 28 will project through the opening 26 and the nut 31 and bolt 32 will extend through the slot 27. Just before this is done, a metal sleeve K, see FIG. 3, is slipped over the cylindrical body 1 of the inner member A, and it has an opening 35 for receiving the nut 31 and bolt 32, as shown in FIG. 7, and it has a second opening 36 for receiving the tongue 28. The under-surface of the cable gripping member J has prongs 37 for gripping the portion of the cable C received in the inner member A. FIG. 2 shows annular portions 38 of the metal sleeve K depressed for forming annular inwardly extending ridges received in the annular grooves 4 in the cylindrical portion 1 of the inner member A.

When the cable gripping member J, is assembled in the inner member A, in the manner just described, a spacing member L of the shape shown in FIG. 6, is inserted into the widened portion 25*a* of the recess 25 in the cylindrical body 1 and the member L has a slot 39 for receiving the nut 31 and bolt 32. The three wires of the cable C are attached to the electrode carrier B, in the manner already described and then the axial projection 13 of the carrier is inserted into the bore 3 of the inner body A, at which point both the carrier and the inner body are inserted into the end cap G, as a unit. The three electrodes D, E and F have previously been inserted through the openings 19 in the end cap and the insertion of the electrode carrier B into the end cap will bring the bare wire strands of the three wires into electrical contact with the electrodes as already explained.

The top cap H has a central opening 40 for receiving the metal sleeve K and the inner body A. The top cap has a threaded interior cylindrical portion 41, see FIG. 2 designed to be threaded onto the exteriorly threaded portion 42 of the end cap G, see also FIG. 3. When the top cap is screwed into place on the end cap G, all of the parts of the electric plug will be securely fastened in place. Note from FIGS. 2 and 5 that the end cap G has longitudinally extending partitions 43 that enter the spaces 44 separating the sides of the three projections 7, 8 and 9 from their adjacent projections 44, see FIG. 4. This arrangement seals off the three bare wire strands of the three wires from contacting each other.

The head of the bolt 32 projects through the opening 35 in the metal sleeve K, and the bolt has a kerf 46 to receive a screw driver bit when the operator wishes to rotate the threaded bolt shank in the nut 31. This will move the bolt carrying member 29 against the spacing member L, and will force the cable gripping member J down upon the cable C to force the prongs 37 into the cable sheathing and prevent the accidental removal of the cable from the electric plug. The tongue 28 prevents the accidental removal of the cable from the member B.

I claim:

1. In an electric plug:

(a) a cable holding member having a longitudinal bore for receiving a cable carrying a plurality of wires;

(b) a cable gripping member positioned in a recess which opens into the bore in said cable holding member, said gripping member having a tongue extending through an opening in said cable holding member;

(c) adjustable means on said cable gripping member for forcing a pronged portion thereof into gripping engagement with the cable;

(d) a metal sleeve enclosing a portion of said cable holding member and having an opening for receiving said tongue;

(e) a spacing member receivable in the recess in the cable holding member and positioned between said cable gripping member and the interior of said sleeve;

(f) said adjustable means including a bolt whose head extends through an opening in said sleeve and having a nut-carrying head secured to a nut-carrying member, the other end of said bolt bearing against said pronged portion and the bolt shank received in said nut; and (g) whereby a rotation of said bolt in said nut will move the nut-carrying member into binding engagement with said spacing member and will force said pronged portion against the cable for anchoring it in the cable holding member.

* * * * *